US012728341B2

(12) United States Patent
Ok

(10) Patent No.: US 12,728,341 B2
(45) Date of Patent: Sep. 8, 2026

(54) HYBRID GOLF SYSTEM AND METHOD FOR AUTOMATIC SCORING USING USER'S MOBILE TERMINAL IN THE SAME

(71) Applicant: GOLFZON CO., LTD., Seoul (KR)

(72) Inventor: Jae Yoon Ok, Goyang-si (KR)

(73) Assignee: GOLFZON CO., LTD., Seoul (KR)

( * ) Notice: Subject to any disclaimer, the term of this patent is extended or adjusted under 35 U.S.C. 154(b) by 127 days.

(21) Appl. No.: 18/876,220

(22) PCT Filed: Jun. 21, 2023

(86) PCT No.: PCT/KR2023/008588

§ 371 (c)(1),
(2) Date: Dec. 18, 2024

(87) PCT Pub. No.: WO2024/005438

PCT Pub. Date: Jan. 4, 2024

(65) Prior Publication Data

US 2025/0375692 A1 Dec. 11, 2025

(30) Foreign Application Priority Data

Jun. 29, 2022 (KR) ..... 10-2022-0079560

(51) Int. Cl.
*A63B 71/06* (2006.01)
*A63B 71/04* (2006.01)
*A63B 102/32* (2015.01)

(52) U.S. Cl.
CPC ..... *A63B 71/0669* (2013.01); *A63B 71/04* (2013.01); *A63B 71/0622* (2013.01);
(Continued)

(58) Field of Classification Search
CPC . A63B 71/0669; A63B 71/04; A63B 71/0622; A63B 2102/32; A63B 2220/806;
(Continued)

(56) References Cited

U.S. PATENT DOCUMENTS 11,207,581 B2 * 12/2021 Nicora ..... G09B 19/0038
12,002,222 B2 * 6/2024 Oh ..... G06T 7/246
(Continued)

FOREIGN PATENT DOCUMENTS

JP 2015-150061 A 8/2015
KR 10-2002-0092266 A 12/2002
(Continued)

OTHER PUBLICATIONS

International Search Report for PCT/KR2023/008588 mailed Jan. 18, 2024 from Korean Intellectual Property Office.

*Primary Examiner* — Oschta I Montoya
(74) *Attorney, Agent, or Firm* — Revolution IP, PLLC

(57) ABSTRACT

The present invention is intended to solve the problems of the prior art as described above, and provides a hybrid golf system and a method by which a controller for controlling same automatically calculates a score, wherein the hybrid golf system may automatically calculate a score based on the entire golf play by automatically calculating a score on the basis of the play on a virtual golf course using a screen golf system, and then automatically calculating, even when playing on an actual field, a score by using a camera sensing system installed around the field.

6 Claims, 8 Drawing Sheets

(52) U.S. Cl.
CPC ..... *A63B 2102/32* (2015.10); *A63B 2220/806* (2013.01); *A63B 2225/50* (2013.01)

(58) Field of Classification Search
CPC ..... A63B 2225/50; A63B 69/36; A63B 71/06; A63B 69/3691; A63B 2220/17; G09B 19/0038
See application file for complete search history.

(56) References Cited

U.S. PATENT DOCUMENTS

| | | | | |
|---|---|---|---|---|
| 2016/0001158 | A1* | 1/2016 | Tawwater ..... | A63B 24/0003 463/3 |
| 2018/0290040 | A1* | 10/2018 | Korpach ..... | A63B 69/3691 |
| 2018/0333630 | A1* | 11/2018 | Jang ..... | A63B 69/3691 |

FOREIGN PATENT DOCUMENTS

| | | | |
|---|---|---|---|
| KR | 10-2012-0009933 | A | 2/2012 |
| KR | 10-2012-0036155 | A | 4/2012 |
| KR | 10-2012-0036156 | A | 4/2012 |
| KR | 10-2013-0030536 | A | 3/2013 |
| KR | 10-2147601 | B1 | 8/2020 |
| KR | 10-2020-0123515 | A | 10/2020 |

* cited by examiner

HYBRID GOLF SYSTEM AND METHOD FOR AUTOMATIC SCORING USING USER'S MOBILE TERMINAL IN THE SAME

CROSS REFERENCE TO PRIOR APPLICATIONS

This application is the 35 U.S.C. 371 national stage of international application PCT/KR2023/008588 filed on Jun. 21, 2023, which claims priority to Korean Patent Application No. 10-2022-0079560 filed on Jun. 29, 2022. The entire contents of each of the above-identified applications are hereby incorporated by reference.

TECHNICAL FIELD

The present invention relates to a hybrid golf system configured such that an approach shot is taken or a putt is made as real golf play on a real field when a virtual ball lands on or around a green during virtual golf play using a virtual golf simulation apparatus and an automatic score calculation method of a controller that controls the same.

BACKGROUND ART

Recently, as the golf population has increased, a so-called screen golf system that allows golfers to practice golf and enjoy virtual rounds of golf using a virtual golf simulation system has emerged.

Such a screen golf system is a system in which a screen capable of displaying a virtual golf course is installed indoors, and when a golfer hits a golf ball toward the screen, the speed, direction, and the like of the golf ball are detected and the trajectory of the golf ball is displayed on the screen, and the system has been technologically evolving in terms of providing users with a realistic feeling of playing a round of golf on a real golf course, beyond the level of simply playing a game of golf indoors.

Conventional screen golf systems have limitations in providing users with the realism of playing a round of golf on a real golf course because a simulation image of a virtual golf course and the trajectory of a ball on the virtual golf course is realized only through the screen installed in front of the user hitting the ball.

In order to overcome this limitation, a so-called hybrid golf system that goes beyond the conventional screen golf systems and provides the same level of realism as playing a round of golf on a real golf course but can be realized in a much smaller space than the real golf course has emerged.

The hybrid golf system is a combination of a real field where real golf can be played and a screen golf system, wherein some of the golf play on a hole may be performed on a virtual golf course implemented by the screen golf system and the rest of the play may be performed as real golf on a real field.

For example, in the case of a par-4 hole, a tee shot and a second shot are taken through virtual golf simulation on the virtual golf course through the screen golf system, and a third shot may be taken and a putt may be made in the same manner as playing golf on a real golf course after a user moves to the real field.

In the part where golf play is performed according to virtual golf simulation on the virtual golf course through the screen golf system, each user does not have to worry about calculating the score because the number of shots of each of the plurality of users is automatically calculated, but when field play is initiated, each user plays golf on the field, and therefore each user has to calculate the score by calculating the number of shots of each user as if playing a round of golf on a real golf course, which is cumbersome and difficult to calculate accurately.

In this regard, conventionally, a golf terminal interlocked with a screen golf system is carried by each user, and the user enters the number of shots through the golf terminal each time the user takes a shot during field play or by memorizing the number of shots on the field.

However, the method of the user entering the number of shots during the field play through the golf terminal is also cumbersome and difficult to calculate accurately due to mistakes or forgetting to enter the score.

PRIOR ART DOCUMENTS

Korean Patent Application Publication No. 10-2013-0030536

Korean Patent Application Publication No. 10-2012-0036155

Korean Patent Application Publication No. 10-2012-0036156

Korean Patent Application Publication No. 10-2012-0009933

DISCLOSURE

Technical Problem

The present invention has been made in view of the above conventional problems, and it is an object of the present invention to provide a hybrid golf system configured such that a score is automatically calculated according to play on a virtual golf course using a screen golf system and a score is automatically calculated using a camera sensing system installed around a real field when playing on the field, thereby automatically calculating a score according to the entire golf play, and an automatic score calculation method of a controller that controls the same.

Technical Solution

An automatic score calculation method of a controller that controls a hybrid golf system according to an embodiment of the present invention, which is an automatic score calculation method of a controller that controls a hybrid golf system including a field configured to allow a plurality of users to play real golf therein and a screen golf module provided on one side of the field, the screen golf module configured to allow the users to play golf on a virtual golf course therein, includes calculating the number of virtual golf shots of each user based on golf play on the virtual golf course in the screen golf module, performing field play subsequent to golf play on the virtual golf course at a ball point, which is the position on the field corresponding to the position of a ball of each user on the virtual golf course, detecting a shot of each user through a camera sensing system including a plurality of cameras configured to detect the field, and calculating a score of each user by summing the number of field shots calculated by detecting the shot of each user through the camera sensing system and the calculated number of virtual golf shots of each user.

In addition, the step of detecting the shot of each user may include recognizing, by the controller, the ball point of each user on the field and the user corresponding to the ball point and detecting the shot of the user at each ball point, detecting movement of a golf ball hit at each ball point through the camera sensing system, and recognizing the next position to which the golf ball is moved from each ball point or recognizing hole-in.

In addition, when the movement of a golf ball from the ball point is detected and hole-in of the golf ball is detected through the camera sensing system in the step of detecting the shot of each user, the step of calculating the score of each user may include calculating a score by adding one shot to the number of virtual golf shots of the user at the ball point and treating the user as having holed out.

In addition, when movement of a golf ball from the ball point is detected and the golf ball having not gone into a hole is detected through the camera sensing system in the step of detecting the shot of each user, the step of calculating the score of each user may include adding one shot to the number of virtual golf shots of the user at the ball point and storing position coordinate information of the moved golf ball.

In addition, the step of detecting the shot of each user may include recognizing, by the controller, the ball point of each user on the field, the user corresponding to the ball point, and a shot sequence at each ball point, setting, by the camera sensing system, a shot detection region of a predetermined size including the ball point in an image acquired by a camera configured to detect the ball point of a user who is next in line to take a shot according to the shot sequence, and detecting the shot of the user by extracting and analyzing the set shot detection region from images continuously acquired by the camera.

In addition, the automatic score calculation method may include recognizing, by the controller, the ball point of each user on the field, the user corresponding to the ball point, and a shot sequence at each ball point, and transmitting shot information to a mobile terminal of a user who is next in line to take a shot according to the shot sequence to notify the user that it is the user's turn to take a shot through the mobile terminal of the user.

Meanwhile, a hybrid golf system according to an embodiment of the present invention includes a screen golf module provided on one side of a field configured to allow a user to play real golf therein, the screen golf module configured to allow the user to play golf on a virtual golf course therein, a simulator provided in the screen golf module, the simulator being configured to implement a virtual golf simulation image of the virtual golf course and golf play of the user, a camera sensing system including a plurality of cameras configured to detect the field, and a controller configured to calculate the number of virtual golf shots of the user based on golf play on the virtual golf course in the screen golf module, to detect a shot of each user at a ball point, which is the position on the field corresponding to the position of a ball of each user on the virtual golf course, through the camera sensing system as field play is performed, and to calculate a score of each user by summing the number of shots of each user according to the field play and the number of virtual golf shots.

In addition, the controller may be configured to recognize the ball point of each user on the field, the user corresponding to the ball point, and a shot sequence at each ball point, to set a shot detection region of a predetermined size including the ball point in an image acquired by a camera configured to detect the ball point of a user who is next in line to take a shot according to the shot sequence, and to detect the shot of the user by extracting and analyzing the set shot detection region from images continuously acquired by the camera.

Advantageous Effects

A hybrid golf system according to the present invention and an automatic score calculation method of a controller that controls the same have the effect that a score is automatically calculated according to play on a virtual golf course using a screen golf system and a score is automatically calculated using a camera sensing system installed around a real field when playing on the field, thereby automatically calculating a score according to the entire golf play.

BEST MODE

A hybrid golf system according to the present invention and an automatic score calculation method of a controller that controls the same will be described in detail with reference to the drawings.

First, the configuration of a hybrid golf system according to an embodiment of the present invention will be described with reference to FIGS. 1 and 2.

Figure 1:
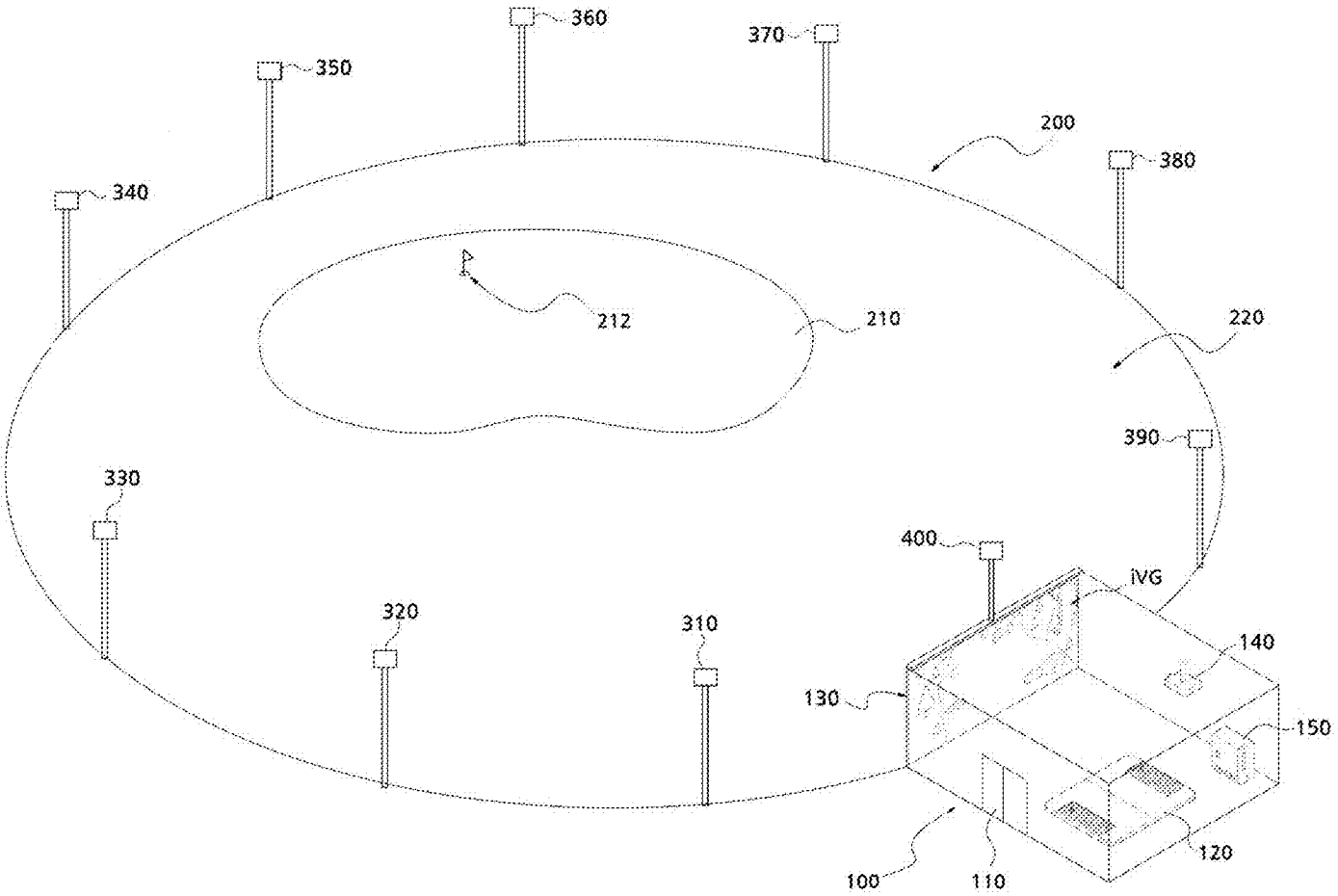
FIG. 1 is a view showing the configuration of a hybrid golf system according to an embodiment of the present invention.
Figure 2:
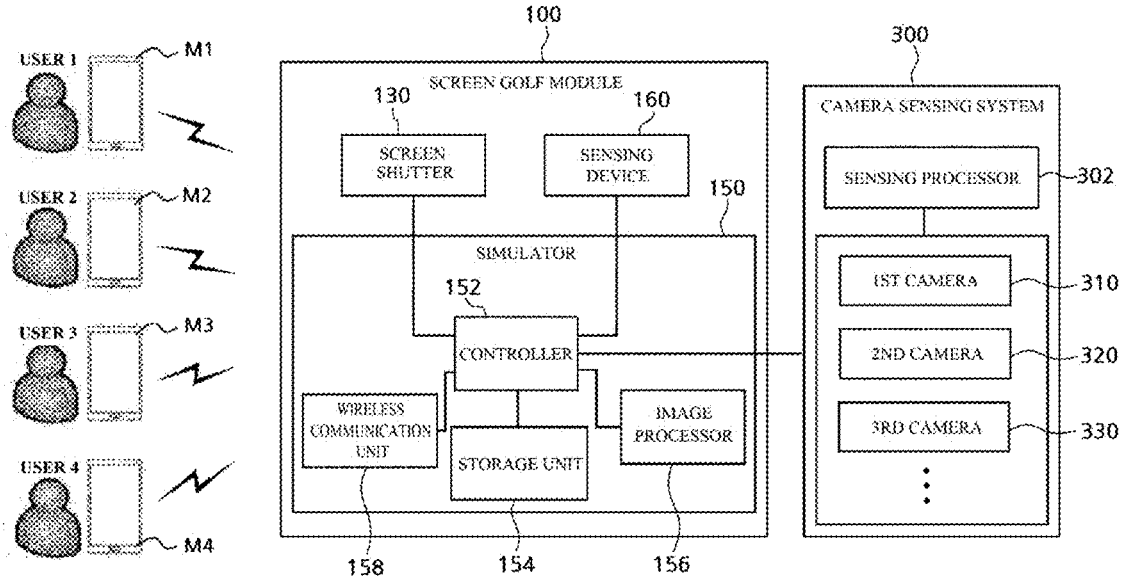
FIG. 2 is a block diagram showing a control system of the hybrid golf system shown in FIG. 1.

FIG. 1 is a view showing the configuration of a hybrid golf system according to an embodiment of the present invention, and FIG. 2 is a block diagram showing a control system of the hybrid golf system shown in FIG. 1.

As shown in FIG. 1, the hybrid golf system according to the embodiment of the present invention may include a field 200 configured to allow a user to play real golf thereon and a screen golf module 100 having a virtual golf simulation apparatus configured to allow the user to play golf on a virtual golf course therethrough.

In addition, the hybrid golf system according to the embodiment of the present invention may include a camera sensing system 130 including a plurality of cameras 310 to 150 configured to detect the field 200.

The screen golf module 100 includes the configuration of a general screen golf system, i.e., the configuration of a virtual golf simulation apparatus that enables a user to play virtual golf by projecting a virtual golf course image onto a screen in front of the user, when the user hits a ball toward the screen in a tee box 120, sensing the same through a sensing device 160, and implementing a simulation image iVG of a virtual ball moving on the virtual golf course image based on the sensing result.

The screen golf module 100 may be configured in the form of a box or a booth having an entrance 110 on one side, and may be configured such that all surfaces are closed or some of the surfaces are open.

The screen golf module 100 may be configured to include a screen 130 on the side facing the field 200.

The screen 130 is a component configured to allow an image of a virtual golf course output by an image output device 140 (e.g., a beam projector) provided in the screen golf module 100 and the simulation image iVG on the virtual golf course to be projected thereon such that the images are provided to the user.

Meanwhile, the field 200 may be configured to form the topography of a part of one hole of a real golf course, may include a green 210 and a hole cup 212, as shown in FIG. 1, and may include a fairway around the green 210 and surrounding areas 220, such as a rough and a bunker, such that the user can actually play approach shots and putts.

In the hybrid golf system according to the embodiment of the present invention, the user may play part of a golf game on the virtual golf course in the screen golf module 100 and may play the remainder of the golf game on the field 200.

For example, in the case of golf play on a par-4 hole, virtual golf may be played on a virtual golf course of the par-4 hole in the screen golf module 100 (golf play in which the user plays a golf shot toward the screen in the tee box and the sensing device senses the hit ball for simulation), and golf play may be resumed on the par-4 hole on the field 200 after the user directly moves to the field 200.

In addition, for example, a tee shot and a second shot on the par-4 hole may be taken as virtual golf play on the virtual golf course in the screen golf module 100, and a third shot (approach shot) may be taken and a putt may be made as actual golf play on the field 200 after the user moves from the screen golf module 100 to the field 200.

The hybrid golf system according to the embodiment of the present invention may use a mobile terminal carried by each user. Here, the mobile terminal may be a personal handheld mobile communication terminal such as a smartphone or a tablet of each user, or may be a dedicated terminal separately provided to each user who uses the hybrid golf system. However, when the mobile terminal is a dedicated terminal as described above, the mobile terminal is preferably a terminal including a GPS and a camera and capable of executing an application, such as a smartphone or a tablet.

As shown in FIG. 2, each user preferably plays golf while carrying his or her own mobile terminal M1, M2, M3, or M4, irrespective of the type of the terminal, and each mobile terminal M1, M2, M3, or M4 may be configured to communicate with a controller 152 while wirelessly communicating with a communication unit 404 of a simulator 150.

Preferably, each user executes an application for use of the hybrid golf system according to the embodiment of the present invention on the mobile terminal M1, M2, M3, or M4, logs in, and performs settings for wireless communication with the communication unit 404 of the simulator in advance.

As shown in FIGS. 1 and 2, the simulator 150 provided in the screen golf module 100 includes a controller 152, an image processor 156, and a storage unit 154 configured to store data, wherein the controller 152 may receive sensing data from the sensing device 160 and may realize a virtual golf simulation image through the image processor 156, and the controller 152 may be configured to transmit and receive data while communicating with the mobile terminal M1, M2, M3, or M4 of each user via the wireless communication unit 158.

Figure 3:
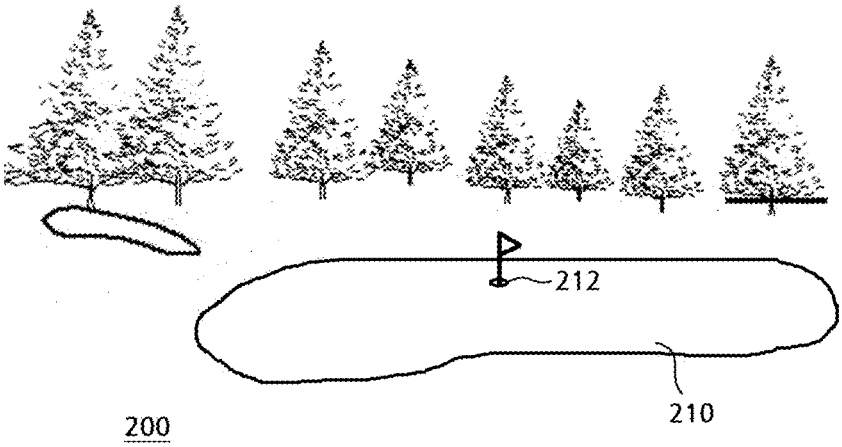
FIG. 3 is a view showing that a user plays virtual golf in a screen golf module shown in FIG. 1 while viewing an image projected on a screen.
Figure 3:
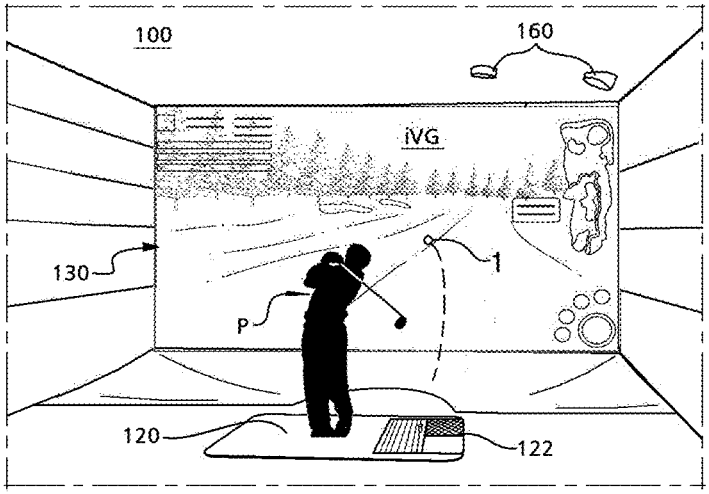

FIG. 3 is a view showing that a user P plays virtual golf in the screen golf module 100 shown in FIG. 1 while viewing the image iVG projected on the screen 130.

The sensing device 160 may be implemented as a camera-based device configured to sense the movement of at least one of a golf club and a golf ball according to a user's golf swing. When the user P hits the golf ball placed on a golf mat 122 in the tee box 120 within the field of view of the camera, the sensing device 160 captures and collects images of the hit golf ball 1, performs analyses such as image processing on the collected images, calculates sensing information such as movement parameters for the movement of the golf ball 1, and transmits the same to the controller 152.

A manipulation device (not shown) may be provided as a means for the user to manipulate in order to set a virtual golf simulation environment or in order to adjust aiming or the like in the course of a virtual round of golf.

The storage unit 154 stores all data necessary for image realization of the virtual golf simulation, and stores data about a virtual golf course realized by imaging a real golf course and data about topography information of the virtual golf course, whereby it is possible to provide data capable of realizing a virtual environment that enables the user to play a virtual round of golf on a virtual golf course selected by the user.

The storage unit 154 may be configured to store all of various data regarding the virtual golf course, or may be configured to receive various data regarding the virtual golf course from a server (not shown) over a network and to temporarily store the same.

The image processor 156 performs information processing to realize an image of the virtual golf course on the screen using data about the virtual golf course stored in the storage unit 154, and performs information processing to realize an image in which the trajectory of the golf ball hit by the user is simulated on the virtual golf course.

The image information processed by the image processor 156 is projected on the screen 130 through the image output device 140, which may be implemented as a projector or the like, such that the user P can view the image iVG projected on the screen 130.

The image processor 156 may be implemented as one modularized part configured to perform an image processing function in one independent device, or may be implemented as one independent device.

The controller 152 is a component configured to control all processing for the virtual golf simulation, and performs various operations and controls to simulate the movement of the virtual ball on the virtual golf course based on the sensing information about the moving golf ball extracted according to the sensing result of the sensing device 160 and physics engine. Based on these various operations and controls, the image iVG in which the virtual ball is simulated on a virtual golf course according to the sensing results of the sensing device and the physics engine may be realized.

The controller 152 may determine whether the requirement for the user to perform field play on the field is satisfied in the process of playing virtual golf on the virtual golf course, and if the requirement for field play is satisfied, the controller 152 may provide image/voice guidance through the screen image iVG for the user to move to the field 200 and perform field play.

In the case of a plurality of users playing a round of golf together, field play as described above may be initiated when all users' balls (virtual balls in an image) are located within a predetermined range on the virtual golf course, such as within a predetermined radius relative to a hole cup (a hole cup on a green of the virtual golf course).

Before field play is initiated, i.e., while the users are engaged in virtual golf play via through simulator 150 in the screen golf module 100, the controller 152 may automatically calculate each score as the users take golf shots on the virtual golf course because the virtual golf play is performed through an image, and after field play is initiated, the controller may calculate a score by detecting each user's golf shot and ball through the camera sensing system 300 because each user is playing on the field.

When field play is initiated as described above, the controller 152 of the simulator 150 may perform control such that each camera of the camera sensing system 300 is ready for sensing, and may calculate the ball point on the field corresponding to each user's ball position on the virtual golf course when field play is initiated.

That is, the controller 152 may use the field 200 as a coordinate space and may calculate coordinate information of the ball point corresponding to the ball position of each user in the coordinate space.

Here, "ball position" refers to the position of each user's ball (ball in the image) on the virtual golf course, and "ball point" refers to the position coordinates in the coordinate space of the field 200 corresponding to the position of each ball.

When field play is initiated as described above, the controller 152 of the simulator 150 transmits a signal indicating initiation of field play to the mobile terminal M1, M2, M3, or M4 of each user and transmits various kinds of information in the course of the virtual golf play, i.e., map information of the virtual golf course, ball position information of each user's ball on the virtual golf course, and score information to the mobile terminal such that field play is possible through each mobile terminal.

In the case of a plurality of users playing a round of golf together, field play as described above may be initiated when all users' balls (virtual balls in an image) are located within a predetermined range on the virtual golf course, such as within a predetermined radius relative to a hole cup (a hole cup on a green of the virtual golf course).

The hybrid golf system according to the embodiment of the present invention may use a mobile terminal carried by each user. Here, the mobile terminal may be a personal handheld mobile communication terminal such as a smartphone or a tablet of each user, or may be a dedicated terminal separately provided to each user who uses the hybrid golf system. However, when the mobile terminal is a dedicated terminal as described above, the mobile terminal is preferably a terminal including a GPS and a camera and capable of executing an application, such as a smartphone or a tablet.

As shown in FIG. 2, each user preferably plays golf while carrying his or her own mobile terminal M1, M2, M3, or M4, irrespective of the type of the terminal, and each mobile terminal M1, M2, M3, or M4 may be configured to communicate with a controller 152 while wirelessly communicating with a communication unit 404 of a simulator 150.

Preferably, each user executes an application for use of the hybrid golf system according to the embodiment of the present invention on the mobile terminal M1, M2, M3, or M4, logs in, and performs settings for wireless communication with the communication unit 404 of the simulator in advance.

As shown in FIGS. 1 and 2, the simulator 150 provided in the screen golf module 100 includes a controller 152, an image processor 156, and a storage unit 154 configured to store data, wherein the controller 152 may receive sensing data from the sensing device 160, and the controller 152 may be configured to transmit and receive data while communicating with the mobile terminal M1, M2, M3, or M4 of each user via the communication unit 404.

Meanwhile, as shown in FIGS. 1 and 2, the camera sensing system 300 of the hybrid golf system according to the embodiment of the present invention may include a plurality of cameras 310 to 400 installed around the field 200 so as to be disposed at predetermined intervals and a sensing processor 302.

The plurality of cameras 310 to 400 is connected to the sensing processor 302, as shown in FIG. 2, and the sensing processor 302 may detect objects on the field 200 from images acquired by the plurality of cameras 310 to 400. For example, the controller may analyze the images acquired by the plurality of cameras to detect a user taking a shot or detect a golf ball moving across the field.

The camera sensing system 300 may be configured to divide the field 200 into predetermined sizes, and each of the cameras installed around the field 200 may be configured to detect a corresponding one of the divided regions.

Figure 4:
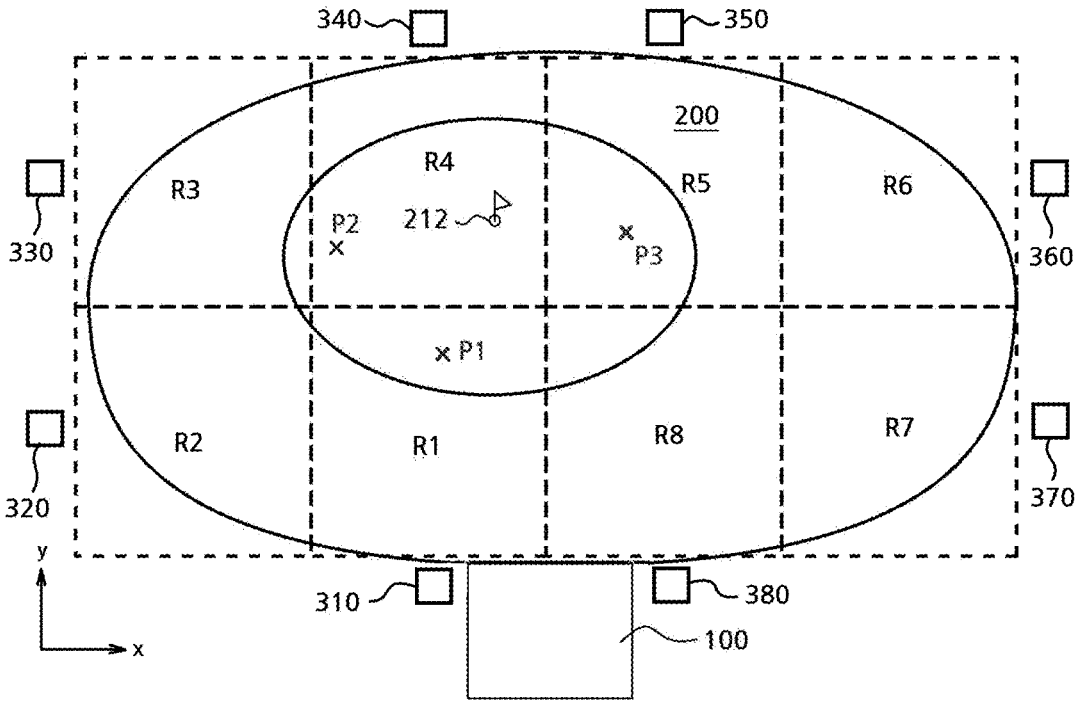
FIG. 4 is a view illustrating an example of a method in which a field is detected by a camera sensing system of the hybrid golf system according to the embodiment of the present invention.

For example, as shown in FIG. 4, the field 200 may be divided into a first divided region R1, a second divided region R2, a third divided region R3, a fourth divided region R4, a fifth divided region R5, a sixth divided region R6, a seventh divided region R7, and an eighth divided region R8, wherein the first divided region R1 may be detected by a first camera 310, the second divided region R2 may be detected by a second camera 320, the third divided region R3 may be detected by a third camera 330, the fourth divided region R4 may be detected by a fourth camera 340, the fifth divided region R5 may be detected by a fifth camera 350, the sixth divided region R6 may be detected by a sixth camera 360, the seventh divided region R7 may be detected by a seventh camera 370, and the eighth divided region R8 may be detected by an eighth camera 380.

The controller may recognize the entire region including all of the divided regions of the field as one x-y coordinate system, as shown in FIG. 4, and may recognize the coordinates of the ball point on the field corresponding to the position of a ball of each user on the virtual golf course at the start of field play when the users play golf in the screen golf module 100.

For example, if three users (users 1, 2, and 3) are playing virtual golf in the screen golf module and a ball of each of users 1 to 3 is located on the green of the virtual golf course or within a predetermined distance around the green, when field play is initiated, the controller may designate the ball point on the field corresponding to the position of the ball of user 1 as P1, the ball point on the field corresponding to the position of the ball of user 2 as P2, and the ball point on the field corresponding to the position of the ball of user 3 as P3, and may store coordinate information of each ball point P1, P2, or P3 in an x-y coordinate plane.

Since the green and the surrounding region on the virtual golf course have different topographies from the field formed in front of the screen golf module, the "ball position" and the "ball point" described above do not exactly match, but the "ball position" and the "ball point" may be matched using various methods. For example, a reference position (e.g., the position of the hole cup) may be set, and the "ball position" and the "ball point" may be matched according to the relative position relationship based on the reference position.

As the user's "ball position" on the virtual golf course and the "ball point" on the field corresponding thereto are thus calculated, the controller may recognize the position coordinates of the ball point of each user on the field when field play is initiated.

When the coordinate information of the ball point of each user is designated as described above, the controller may transmit the information to the mobile terminal carried by each user, and a mobile terminal of a user who is next in line to take a shot according to the shot sequence by the ball point may provide shot guidance.

If a user's shot is taken at ball point P1 (located in region R1) according to the shot sequence, the mobile terminal of user 1 may provide shot guidance to the user, and the controller may detect the shot of user 1 from the image processing result of region R1 acquired by the first camera 310 of the camera sensing system, if a user's shot is taken at ball point P2 (located in region R4) according to the next shot sequence, the mobile terminal of user 2 may provide shot guidance to the user, and the controller may detect the shot of user 2 from the image processing result of region R4 acquired by the fourth camera 340 of the camera sensing system, and if a user's shot is taken at ball point P3 (located in region R5) according to the next shot sequence, the mobile terminal of user 3 may provide shot guidance to the user, and the controller may detect the shot of user 3 from the image processing result of region R5 acquired by the fifth camera 350 of the camera sensing system.

Hereinafter, an automatic score calculation method of the controller that controls the hybrid golf system according to the embodiment of the present invention will be described with reference to FIGS. 5 to 8.

Figure 5:
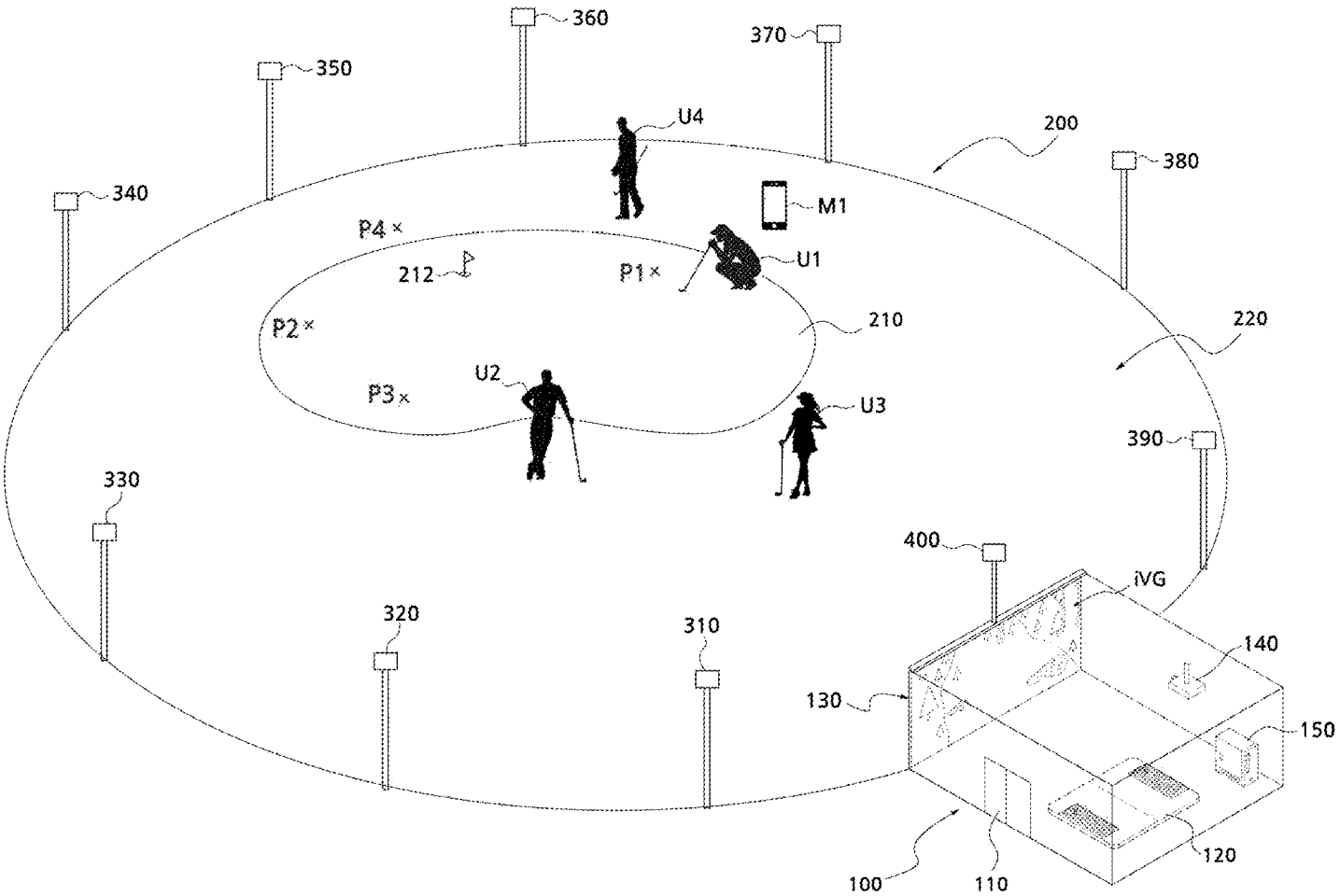
FIG. 5 is a view showing the case in which field play is initiated in the hybrid golf system according to the embodiment of the present invention.
Figure 6:
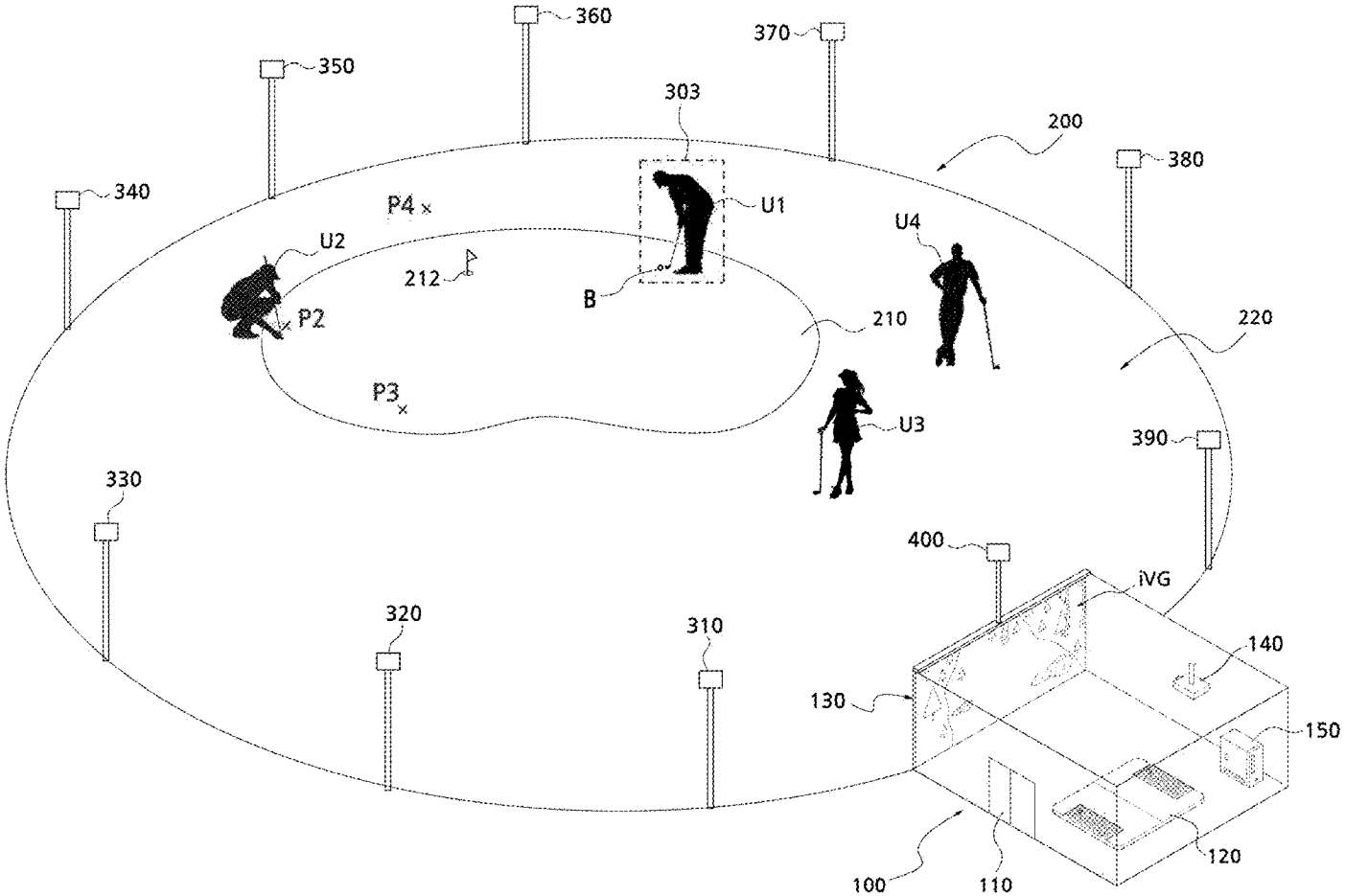
FIG. 6 is a view showing the case in which a user's shot is detected by the camera sensing system in the state shown in FIG. 5.
Figure 7:
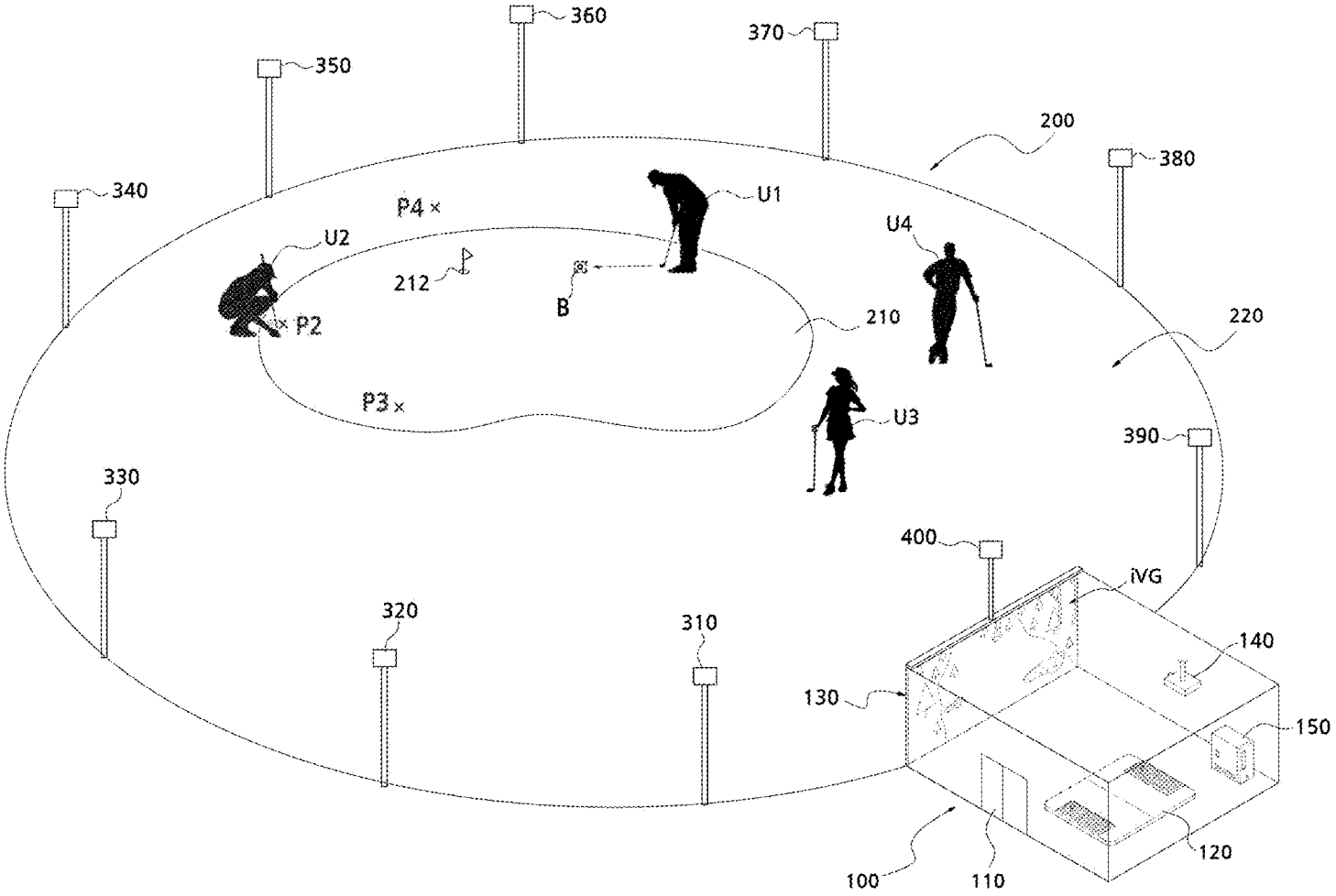
FIG. 7 is a view showing a case in which a ball is detected by the camera sensing system as a user takes a shot in the state shown in FIG. 6.
Figure 8:
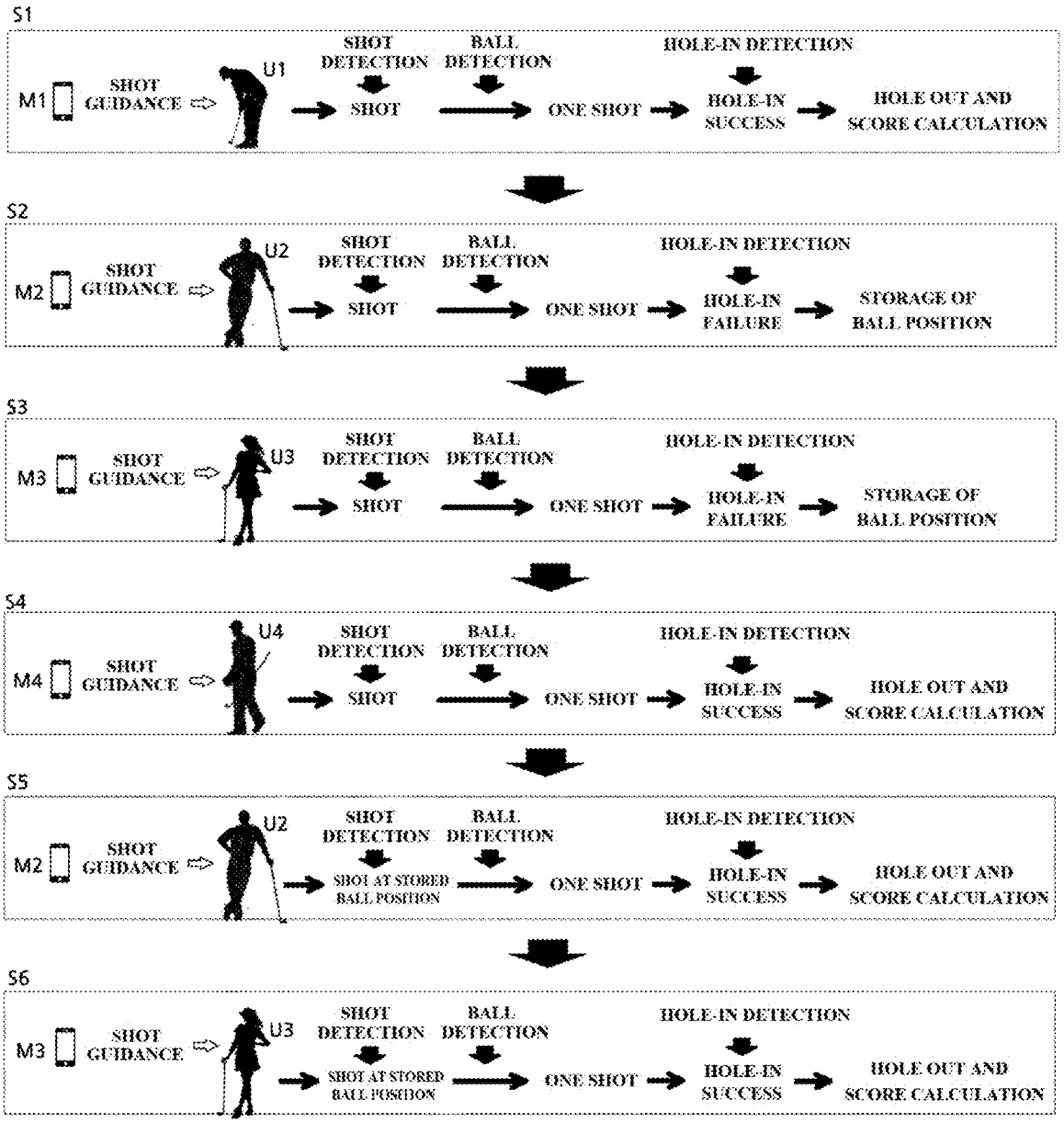
FIG. 8 is a view illustrating an automatic score calculation method of a controller that controls the hybrid golf system according to the embodiment of the present invention.

FIG. 5 is a view showing the case in which field play is initiated in the hybrid golf system according to the embodiment of the present invention, FIG. 6 is a view showing the case in which a user's shot is detected by the camera sensing system in the state shown in FIG. 5, FIG. 7 is a view showing a case in which a ball is detected by the camera sensing system as a user takes a shot in the state shown in FIG. 6, and FIG. 8 is a view illustrating an automatic score calculation method of the controller that controls the hybrid golf system according to the embodiment of the present invention.

FIGS. 5 to 8 show that four users, i.e., user 1 (U1), user 2 (U2), user 3 (U3), and user 4 (U4), are engaged in virtual golf play in the screen golf module 100, and when the requirements for initiating field play as described above are satisfied, field play is initiated, the four users appear on the field 200 to play, and a score is automatically calculated.

As shown in FIG. 5, as field play is initiated, the controller stores coordinate information of ball point P1 of user 1 (U1), ball point P2 of user 2 (U2), ball point P3 of user 3 (U3), and ball point P4 of user 4 (U4) as the ball points on the field corresponding to the ball positions of the four users on the virtual golf course.

Since the controller already knows the ball positions of the four users on the virtual golf course and has calculated the ball points on the field 200 accordingly, the controller knows which ball point on the field 200 belongs to which user and also knows the shot sequence based on the ball points.

In the state shown in FIG. 5, the shot sequence is P1->P2->P3->P4 according to the distance from the hole cup 212, and the shot sequence of user 1 (U1)->user 2 (U2)->user 3 (U3)->user 4 (U4) is shown.

The controller may provide shot guidance (guidance using a voice, a screen display, or the like) indicating that it is the user's turn to take a shot to user 1 (U1) through the mobile terminal M1 of user 1 (U1) to take a first shot according to the shot sequence as described above.

User 1 (U1) may place a golf ball at his or her ball point and take a golf shot according to guidance of his or her mobile terminal M1 or by a separate means.

FIG. 6 shows the camera sensing system detects that user 1 (U1) takes the golf shot according to the guidance of the mobile terminal M1 as described above.

Since the controller already knows ball point P1 of user 1 (U1), the controller may detect the golf shot of the user by extracting a region of interest around ball point P1, i.e., a shot detection region 303, from the acquired image of the camera (the sixth camera 360 or the seventh camera 370 in the figure) that acquires the image of ball point P1 and detecting an object corresponding to user 1 (U1) in the extracted shot detection region 303.

In FIG. 6, the shot detection region 303 is directly shown for convenience of description, but in practice, a golf shot of a user may be detected by setting a region of a predetermined size including a ball point in an acquired image of a camera that acquires an image of a region including the ball point as a shot detection region, extracting a part corresponding to the set shot detection region from the acquired image, and detecting an object corresponding to the user in the extracted shot detection region.

The shot detection region may be continuously extracted from the images continuously acquired by the camera of the camera sensing system, and the controller may extract an object corresponding to a golf ball B in the continuously extracted shot detection region, and if the object corresponding to the golf ball is not detected in the shot detection region, the controller may determine that the user has taken a shot.

When the golf ball hit by the user moves, the moving golf ball may be detected by detecting an object corresponding to the golf ball from the images acquired by the cameras of the camera sensing system (hereinafter, detection of the golf ball by the camera sensing system will be referred to as "ball detection"). This is shown in FIG. 7.

The controller may recognize that the user is taking a golf shot through the shot detection region, and may recognize the golf ball by detecting an object corresponding to the golf ball in the image acquired by the camera detecting the region.

As such, the controller may detect the movement of the golf ball by detecting the object corresponding to the golf ball in the image through the camera sensing system, and since the controller already knows the position of the hole cup 212, the controller may recognize that the golf ball has gone into the hole when the golf ball disappears from the position of the hole cup while detecting the object corresponding to the golf ball in the image and thus the controller can no longer detect the object corresponding to the golf ball in the image.

The controller may recognize that the golf ball has not gone into the hole if the controller detects that the golf ball is moving through the camera sensing system and then detects that the golf ball has stopped.

If the golf ball has gone into the hole, the user who has taken the shot may be treated as having holed out and a score may be calculated by calculating the number of shots up to that time. If the golf ball has not gone into the hole, the coordinate information of the position where the golf ball stopped may be stored, and when it is the turn of the user to take the shot next time, the shot detection and ball detection of the user through the shot detection region described above may be performed at the stored position, whereby the number of shots of the user may be calculated.

As shown in FIGS. 6 and 7, after the golf shot of user 1 (U1) is taken, shot guidance may be provided through the mobile terminal of user 2 (U2), who is next in line to take a shot according to the shot sequence, and the number of shots of user 2 may be added through shot detection and ball detection by the camera sensing system. In this way, the number of shots may be added through shot detection and ball detection of all users according to the shot sequence.

A method in which the controller of the hybrid golf system according to the embodiment of the present invention calculates a score is shown in FIG. 8.

Referring to FIG. 8, when the shot sequence is user 1 (U1)->user 2 (U2)->user 3 (U3)->user 4 (U4), first, the controller performs a step of providing shot guidance through the mobile terminal M1 of user 1 and detecting that user 1 is taking a shot through a camera sensing system (S1).

When user 1 takes a shot at his or her ball point, the controller may detect whether user 1 has taken the shot by shot detection through the camera sensing system, may detect the position of the golf ball through ball detection, and may detect whether the golf ball moved by the shot has gone into the hole.

If the golf ball hit by the user is detected to have gone into the hole, the controller treats the user as having holed out, excludes the user from shot guidance targets, and calculates a score of the shots taken by the user up to that time. That is, the score may be calculated by summing the number of shots taken by the user while playing virtual golf in the screen golf module and the number of shots taken by the user while playing on the field until the gold ball goes into the hole.

In this way, the controller may proceed to the next step of detecting the shot of user 2 (S2), followed by the next step of detecting the shot of user 3 (S3), followed by the next step of detecting the shot of user 4 (S4).

Shot detection, ball detection, and hole-in detection for each of users 2, 3, and 4 are performed in the same manner as for user 1 described above.

However, if the golf ball hit by the user has gone into the hole, the golf ball is holed out and the score is calculated, but if the golf ball hit by the user has not gone into the hole, the controller detects the position where the golf ball stopped and stores the detected position as the position of the ball because the controller detects the position of the golf ball through the camera sensing system, and then detects the user's shot again at the stored ball position when the next shot is taken.

According to the example shown in FIG. 1, as a result of shot detection, ball detection, and hole-in detection for the shot of user 1, hole-in succeeds, which results in hole out, and a score is calculated by adding one shot to the number of shots in the screen golf module (S1).

Next, as a result of shot detection, ball detection, and hole-in-one detection for the shot of user 2, hole-in fails, and the controller stores the position where the golf ball stopped (S2).

Next, as a result of shot detection, ball detection, and hole-in-one detection for the shot of user 3, hole-in also fails, and the controller stores the position where the golf ball stopped (S3).

Next, as a result of shot detection, ball detection, and hole-in detection for the shot of user 4, hole-in succeeds, which results in hole out, and a score is calculated by adding one shot to the number of shots in the screen golf module (S4).

User 1 and user 4 are excluded from the shot guidance targets because they have holed out, and the shot sequence is calculated again according to the positions of the balls of user 2 and user 3, who failed to hole in (here, the shot sequence is user 2->user 3). Accordingly, after the mobile terminal M2 of user 2 provides shot guidance, user 2 takes a second shot at the stored position of the ball (the position of the ball as a result of the shot taken by user 2 in step S2), and as a result of shot detection, ball detection, and hole-in detection therefor, hole-in succeeds, which results in hole out, and a score is calculated by adding two shots to the number of shots in the screen golf module (S5).

Next, after the mobile terminal M3 of user 3 provides shot guidance, user 3 takes a second shot at the stored position of the ball (the position of the ball as a result of the shot taken by user 3 in step S3), and as a result of shot detection, ball detection, and hole-in detection therefor, hole-in succeeds, which results in hole out, and a score is calculated by adding two shots to the number of shots in the screen golf module (S6).

In a hybrid golf system according to an embodiment of the present invention and an automatic score calculation method of a controller that controls the same, the controller calculates the number of virtual golf shots as a plurality of users plays golf on a virtual golf course in a screen golf module, as the plurality of users performs field play, field play is performed at the ball point, which is the position on the field corresponding to the position of a ball of each user on the virtual golf course, and the controller detects a shot of each user through a camera sensing system, calculates the number of shots of each user on the field, and sums the number of virtual golf shots and the number of shots on the field, thereby automatically calculating a score of each user.

As described above, a hybrid golf system according to the present invention and an automatic score calculation method of a controller that controls the same have the effect that a score is automatically calculated according to play on a virtual golf course using a screen golf system in the hybrid golf system and a score is automatically calculated using a camera sensing system installed around a real field when playing on the field, thereby automatically calculating a score according to the entire golf play, and therefore the score may be automatically calculated even if the user playing golf using the hybrid golf system does not count the number of shots, which improves user convenience.

INDUSTRIAL APPLICABILITY

A hybrid golf system according to the present invention and an automatic score calculation method of a controller that controls the same are applicable to the industry related to golf and the so-called screen golf industry that enables golf play to be enjoyed based on virtual golf simulation.

The invention claimed is:

1. An automatic score calculation method of a controller that controls a hybrid golf system comprising a field configured to allow a plurality of users to play real golf therein and a screen golf module provided on one side of the field, the screen golf module configured to allow the users to play golf on a virtual golf course therein, the automatic score calculation method comprising:

calculating the number of virtual golf shots of each user based on golf play on the virtual golf course in the screen golf module;

performing field play subsequent to golf play on the virtual golf course at a ball point, which is a position on the field corresponding to a position of a ball of each user on the virtual golf course;

detecting a shot of each user through a camera sensing system comprising a plurality of cameras configured to detect the field; and calculating a score of each user by summing the number of field shots calculated by detecting the shot of each user through the camera sensing system and the calculated number of virtual golf shots of each user;

wherein the step of detecting the shot of each user comprises:

recognizing, by the controller, the ball point of each user on the field, the user corresponding to the ball point, and a shot sequence at each ball point;

setting, by the camera sensing system, a shot detection region of a predetermined size comprising the ball point in an image acquired by a camera configured to detect the ball point of a user who is next in line to take a shot according to the shot sequence; and detecting the shot of the user by extracting and analyzing the set shot detection region from images continuously acquired by the camera.

2. The automatic score calculation method according to claim 1, wherein the step of detecting the shot of each user comprises:

recognizing, by the controller, the ball point of each user on the field and the user corresponding to the ball point and detecting the shot of the user at each ball point;

detecting movement of a golf ball hit at each ball point through the camera sensing system; and recognizing a next position to which the golf ball is moved from each ball point or recognizing hole-in.

3. The automatic score calculation method according to claim 1, wherein when movement of a golf ball from the ball point is detected and hole-in of the golf ball is detected through the camera sensing system in the step of detecting the shot of each user, the step of calculating the score of each user comprises calculating a score by adding one shot to the number of virtual golf shots of the user at the ball point and treating the user as having holed out.

4. The automatic score calculation method according to claim 1, wherein when movement of a golf ball from the ball point is detected and the golf ball having not gone into a hole is detected through the camera sensing system in the step of detecting the shot of each user, the step of calculating the score of each user comprises adding one shot to the number of virtual golf shots of the user at the ball point and storing position coordinate information of the moved golf ball.

5. The automatic score calculation method according to claim 1, comprising:

recognizing, by the controller, the ball point of each user on the field, the user corresponding to the ball point, and a shot sequence at each ball point; and transmitting shot information to a mobile terminal of a user who is next in line to take a shot according to the shot sequence to notify the user that it is the user's turn to take a shot through the mobile terminal of the user.

6. A hybrid golf system comprising:

a screen golf module provided on one side of a field configured to allow a user to play real golf therein, the screen golf module configured to allow the user to play golf on a virtual golf course therein;

a simulator provided in the screen golf module, the simulator being configured to implement a virtual golf simulation image of the virtual golf course and golf play of the user;

a camera sensing system comprising a plurality of cameras configured to detect the field; and a controller configured to calculate the number of virtual golf shots of the user based on golf play on the virtual golf course in the screen golf module, to detect a shot of each user at a ball point, which is a position on the field corresponding to a position of a ball of each user on the virtual golf course, through the camera sensing system as field play is performed, and to calculate a score of each user by summing the number of shots of each user according to the field play and the number of virtual golf shots;

wherein the controller is configured:

to recognize the ball point of each user on the field, the user corresponding to the ball point, and a shot sequence at each ball point;

to set a shot detection region of a predetermined size comprising the ball point in an image acquired by a camera configured to detect the ball point of a user who is next in line to take a shot according to the shot sequence; and to detect the shot of the user by extracting and analyzing the set shot detection region from images continuously acquired by the camera.

* * * * *